United States Patent [19]

Herrnring et al.

[11] 4,265,726

[45] May 5, 1981

[54] ALUMINUM PLATING CELL

[75] Inventors: Gunther Herrnring, Alvesloe; Klaus P. Nussen, Hamburg, both of Fed. Rep. of Germany

[73] Assignee: Montblanc-Simplo GmbH, Hamburg, Fed. Rep. of Germany

[21] Appl. No.: 110,106

[22] Filed: Jan. 7, 1980

[30] Foreign Application Priority Data

Jan. 17, 1979 [DE] Fed. Rep. of Germany ..... 2901586

[51] Int. Cl.[3] ..... C25D 17/28; C25D 21/00; C25C 1/02; C25C 3/06

[52] U.S. Cl. ..... 204/202; 204/237; 204/245; 204/246

[58] Field of Search ..... 204/39, 14 N, 225, 243–247, 204/237, 202

[56] References Cited

U.S. PATENT DOCUMENTS

| | | | |
|---|---|---|---|
| 1,838,666 | 12/1931 | Fink et al. | 204/225 |
| 2,897,129 | 7/1959 | Dilling | 204/225 |
| 3,136,709 | 6/1964 | Smith et al. | 204/39 X |
| 4,053,383 | 10/1977 | Dötzer et al. | 204/225 |

FOREIGN PATENT DOCUMENTS

| | | | |
|---|---|---|---|
| 2716805 | 10/1978 | Fed. Rep. of Germany | 204/14 N |
| 2719680 | 11/1978 | Fed. Rep. of Germany | 204/14 N |

*Primary Examiner*—Delbert E. Gantz
*Assistant Examiner*—D. R. Valentine
*Attorney, Agent, or Firm*—James E. Nilles

[57] ABSTRACT

To prevent transport of deleterious oxygen and moisture to liquid electrolyte in an aluminum electroplating vessel, workpieces move towards the vessel through an antechamber containing inert gas under pressure and comprising a plenum chamber opening downwardly into a lock chamber containing aprotic liquid. They move down into the liquid, then up out of it, into and through an inverted-U-shaped passageway containing higher pressure inert gas and which communicates with the lock chamber below the surface of the liquid therein and communicates with the electrolysis vessel above the surface of the electrolyte. At each connection between parts, where atmospheric oxygen might move towards the electrolyte, there are double mechanical seals defining a substantially annular chamber filled with aprotic liquid that forms a gas barrier, and such liquid is, where possible, shielded by inert gas.

6 Claims, 8 Drawing Figures

FIG. 6
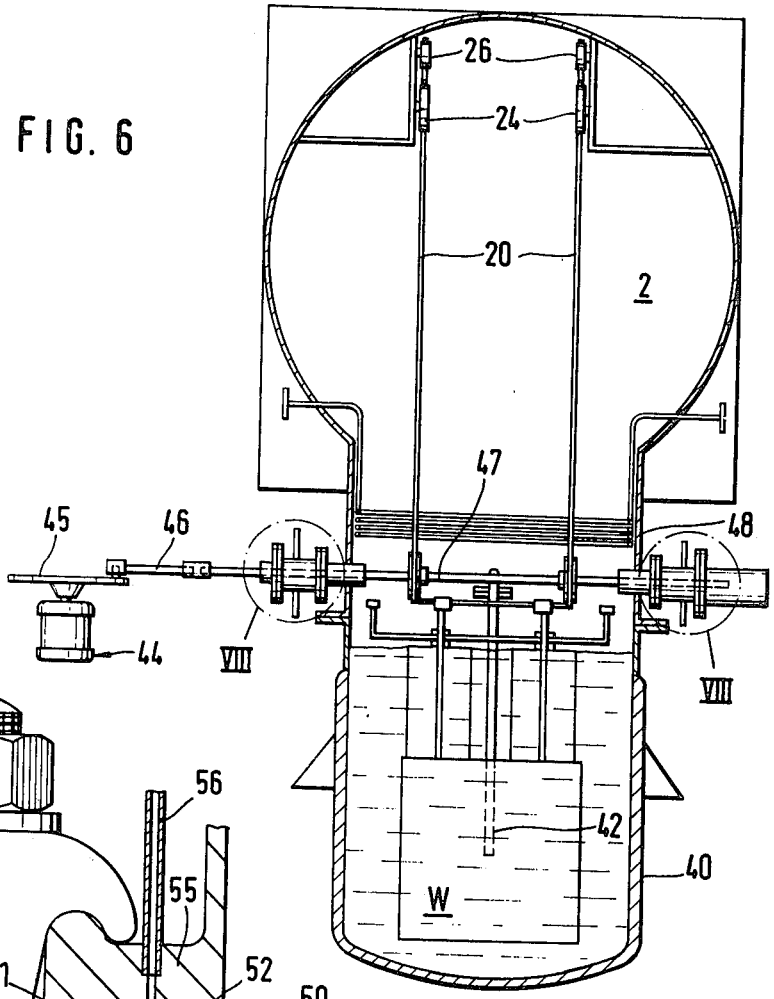
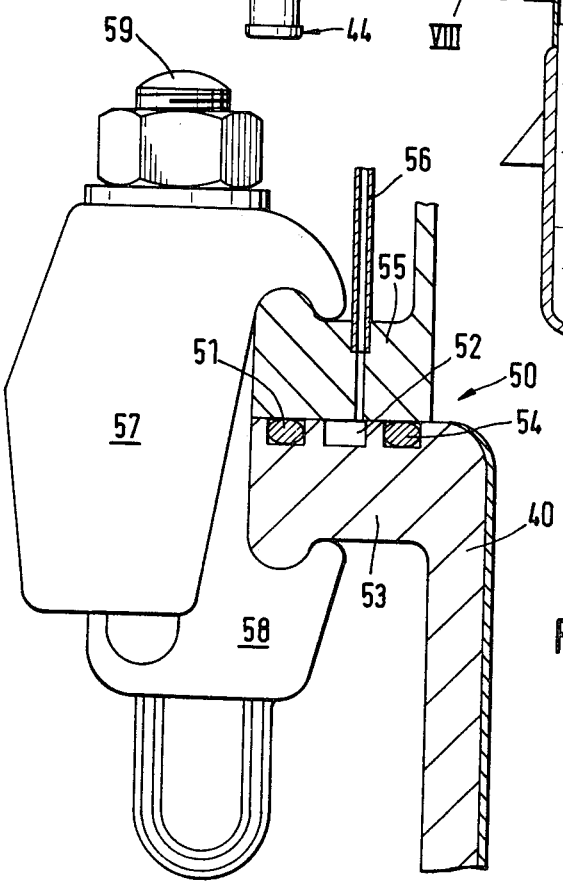
FIG. 7

ALUMINUM PLATING CELL

FIELD OF THE INVENTION

This invention relates to apparatus for aluminum electroplating, of the type comprising a plating vessel and means in the nature of a liquid lock through which workpieces to be plated are moved into and out of that vessel and by which air and moisture are prevented from having access to the contents of the vessel.

BACKGROUND OF THE PRIOR ART

At present three aprotic electrolytes are employed for aluminum electroplating, in the form of complex salt melts or organic solutions. The aluminum-yielding compounds of these respective electrolytes are:

1. Aluminum chloride $AlCl_3$ and $AlBr_3$,
2. Al (III) hydride $AlH_3$ in mixture with $AlCl_3$,
3. Al (III) alkyl, particularly $Al(C_2H_5)_3$.

These form electrically conductive complex compounds with alkali metal halogens or hydrides. The baths which comprise these electrolytes must be protected from moisture and oxygen since, for example, in the case of the third type of electrolyte listed above, one mole of $O_2$ effects the destruction of 2 mols of electrolyte:

$$2Al(C_2H_5)_3+O_2\rightarrow 2(C_2H_5)_2-Al\text{-}O\text{-}C_2H_5.$$

One mol of $H_2O$ can make 2 to 3 mols of electrolyte ineffective because the aluminum ethylates are rendered incapable of building complexes, with the result that they show no electrical conductivity and their formation constitutes a loss of electrolyte.

With respect to the inert gas space that is maintained over the electrolyte in a cell of the type here under consideration, the electrolyte can be regarded as acting like a getter pump for $O_2$ and $H_2O$. This getter pump tries to maintain unmeasureably small partial pressures of $O_2$ and $H_2O$ in its inert gas space, and to the extent that those substances are present in that space it consumes itself in removing them. Therefore, apparatus that is to be technically useful for electrolytic deposition of aluminum must exhibit a leakage rate for atmospheric gases which is as small as that of a high vacuum installation, in order for the electrolytes to have a useful life (about one year) that is economically satisfactory and to ensure that the amount of derivative product of the electrolyte that is deposited on the walls and service elements in the inert gas space is not excessive from the standpoint of machine technology.

For introducing and removing the workpieces that are to be electroplated, the electrolyte chamber must have at least one opening that can be sealed shut, and conventionally the workpieces are moved into and out of the electrolyte chamber through a lock which is intended to prevent oxygen and atmospheric moisture from entering the electrolyte. Because of the relatively large frame needed for supporting the parts that are to be electroplated, the provision of suitable mechanical vacuum valves would be very costly. Furthermore, it would be difficult to test the security of seal afforded by such valves while the apparatus was in operation, and any repair of such a valve would require shutdown of the electroplating cell.

In other applications and processes, generally similar problems have been successfully solved with the employment of U-shaped liquid locks of the type illustrated in FIG. 1. Adjacent to the electroplating vessel proper, which is designated by G, there is a lock S that is filled with liquid. The lock chamber S is communicated with the electroplating vessel G through an inverted-U-shaped passage that is filled with inert gas. The directions taken by workpieces moved into the electroplating vessel G are designated by arrows, and the pieces are removed by transporting them in the reverse direction. Inert gas is filled into the inert gas space I through an overpressure valve V which is communicated with that space, to provide for maintenance therein of a pressure slightly above atmospheric.

As might have been expected, an attempt to use such an arrangement in connection with an aluminum electroplating cell showed it to be wholly unsatisfactory. With an electrolyte system comprising the second of the above-given aluminum-yielding compounds, diethyl ether was tried as the lock chamber fluid; and toluol was tried with the third of the above given compounds. Other liquids were investigated for the purpose, but it was not possible to find one suitable for an aluminum plating process that provided an adequate barrier to the passage of oxygen and moisture between the atmosphere and the electrolyte space.

The transport of moisture through the lock fluid was found to be particularly high. This was apparently because the liquid in the lock chamber is agitated, rather than still, during locking in and out of the pieces to be plated, and because of the difference between temperatures outside the apparatus and inside it. By way of example, an experimental installation had in its lock 160 liters of toluol with a surface area of 0.25 $m^2$, and had an electrolyte bath with 0.2 $m^2$ of surface area, containing 80 liters of electrolyte, corresponding to about 270 mols of $Al(C_2H_5)_3$. With a relative humidity of 40% to 50%, about 10 mols of $H_2O$ passed through the lock daily, and therefore the electrolyte became unusable in much too short a time for economical operation. With this same installation the oxygen transport was found to be about 0.2 mols per day, and this value was likewise too high for an aluminum electroplating cell to be regarded as functioning and operating economically.

The transport of $H_2O$ could be improved with the employment of known technical processes for drying toluol with the use of silica gel posts that are regenerated with freshly distilled dry toluol. This process is very expensive if the toluol is to be dried to about 5 to 10 ppm of $H_2O$ from the moisture values of 220 to 280 ppm, which is specified for an atmosphere of 40% to 50% relative humidity, and with a very efficient drying circuit for the toluol to accommodate the speed with which moisture is taken up by toluol exposed to the atmosphere. For example, in the above-discussed investigation the water content of 200 ml of toluol, with a surface of 16 $cm^2$, agitated by stirring, and with an air flow of 0.8 liters/min. (41% relative humidity) rose from 5 ppm to 190 ppm in one hour. A suitable circuit for drying toluol from such high moisture content values would be an almost economically prohibitive burden for an aluminum electroplating process, due to its technical costliness and its high energy consumption.

SUMMARY OF THE INVENTION

The general object of the present invention is to provide an improved aluminum electroplating cell in which the above described problems and difficulties are overcome in an economical and technically simple manner, and which enables a liquid lock to be employed for excluding oxygen and moisture from the electrolyte bath, without the need for an expensive mechanical lock.

Another and more specific object of this invention is to provide electrolytic aluminum plating apparatus wherein the transport of oxygen to the electrolyte bath takes place at values so low that they cannot be measured with certainty, and wherein the transport of water is reduced by a factor of $10^2$ to $10^3$, with the result that it becomes possible to retain the electrolytes for an economically feasible period of at least a year.

In general, these objects of the invention are attained in an aluminum electroplating cell of the type comprising an electroplating vessel that contains liquid electrolyte and lock means through which workpieces pass in moving into and out of said vessel and by which the electrolyte is substantially shielded from oxygen and moisture. In the electroplating cell of this invention the lock means comprises a liquid lock chamber which is spaced from the electroplating vessel and in which there is contained a quantity of an aprotic solvent, and means defining an inverted-U-shaped passage which contains inert gas at an above-atmospheric pressure and which opens to said liquid lock chamber at a level below that of the surface of said aprotic solvent therein and opens to said vessel at a level above that of the electrolyte therein. The invention is further characterized by means defining an antechamber having a sealing door through which workpieces are introduced into the cell and removed therefrom, which antechamber can be charged with an inert gas at an above-atmospheric pressure and communicates downwardly with said liquid lock chamber at a level above that of the surface of said aprotic solvent therein.

BRIEF DESCRIPTION OF DRAWINGS

In the accompanying drawings, which illustrate what is now regarded as a preferred embodiment of the invention:

FIG. 6 is a view in vertical section taken on the plane of the line 6—6 of FIG. 3;

FIG. 7 is a fragmentary view on an enlarged scale, partly in section, showing the releasable container seals designated by VII in FIG. 3.

DETAILED DESCRIPTION OF PREFERRED EMBODIMENT OF INVENTION

Figure 1:
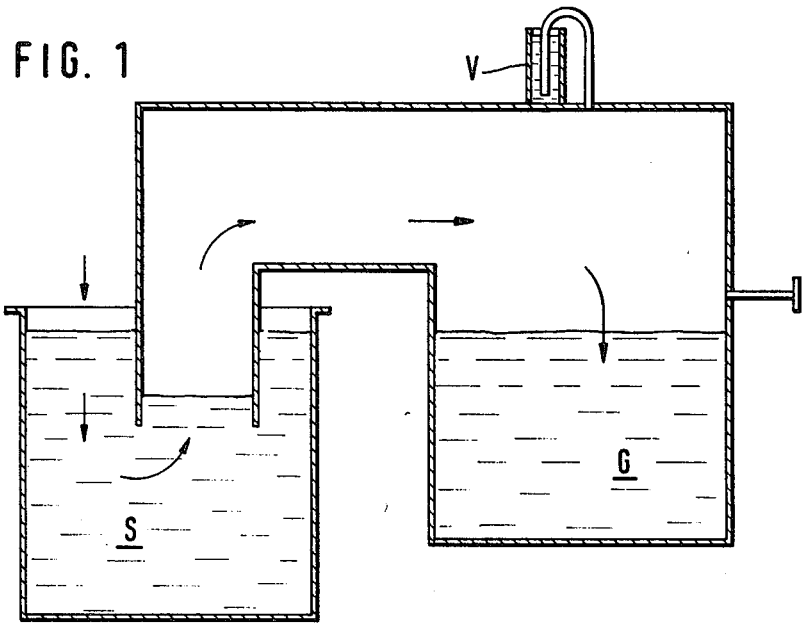
FIG. 1 is a schematic illustration of an electroplating cell according to the prior state of the art.
Figure 2:
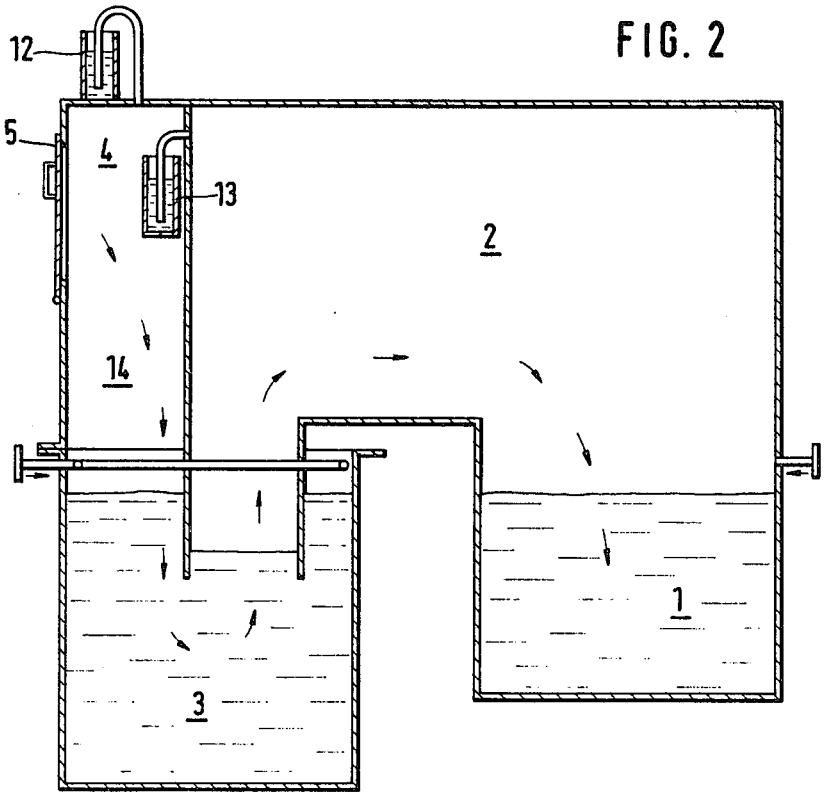
FIG. 2 is a schematic view comparable to FIG. 1 but diagrammatically illustrating apparatus that embodies the present invention.

Referring now to the accompanying drawings, the aluminum electroplating cell of this invention, as can be seen from FIG. 2, bears some resemblance to the known arrangement illustrated in FIG. 1 in that it comprises an electroplating vessel 1, a liquid filled lock chamber 3 which is spaced from the electroplating vessel 1, and means defining an inverted-U-shaped passageway 2 which communicates between the lock chamber 3, at a level below the top of the liquid therein, and the top of the vessel 1. The U-shaped passageway 2 is filled with inert gas at an above-atmospheric pressure. In the prior art apparatus according to FIG. 1, the pieces to be electroplated in the vessel 1 were introduced directly into the lock chamber; but in the apparatus of the present invention, by contrast, there is a closed antechamber 4, capable of being sealed off from the atmosphere by an essentially gas-tight door, in which the workpieces are placed before they are moved into the lock chamber 3. The door 5 is in the upper portion of the antechamber 4, and the bottom portion of the antechamber comprises a plenum chamber 14 that opens downwardly to the surface of the liquid in the lock chamber 3.

The pressure of inert gas in the inverted-U-shaped passage 2 is somewhat higher than that in the antechamber 4 and is maintained so with the help of a relief valve 13 which exhausts to the antechamber 4. In turn, the pressure in the antechamber is maintained at a value slightly above atmospheric pressure with the help of a relief valve 12 that opens to the exterior. The inert gas in the passageway space 2 is maintained as dry and oxygen-free as possible.

The lock chamber 3 is filled with an aprotic solvent, that is, a solvent which is incapable of acting as a proton acceptor or a proton donor, or as an acid or a base.

Figure 3:
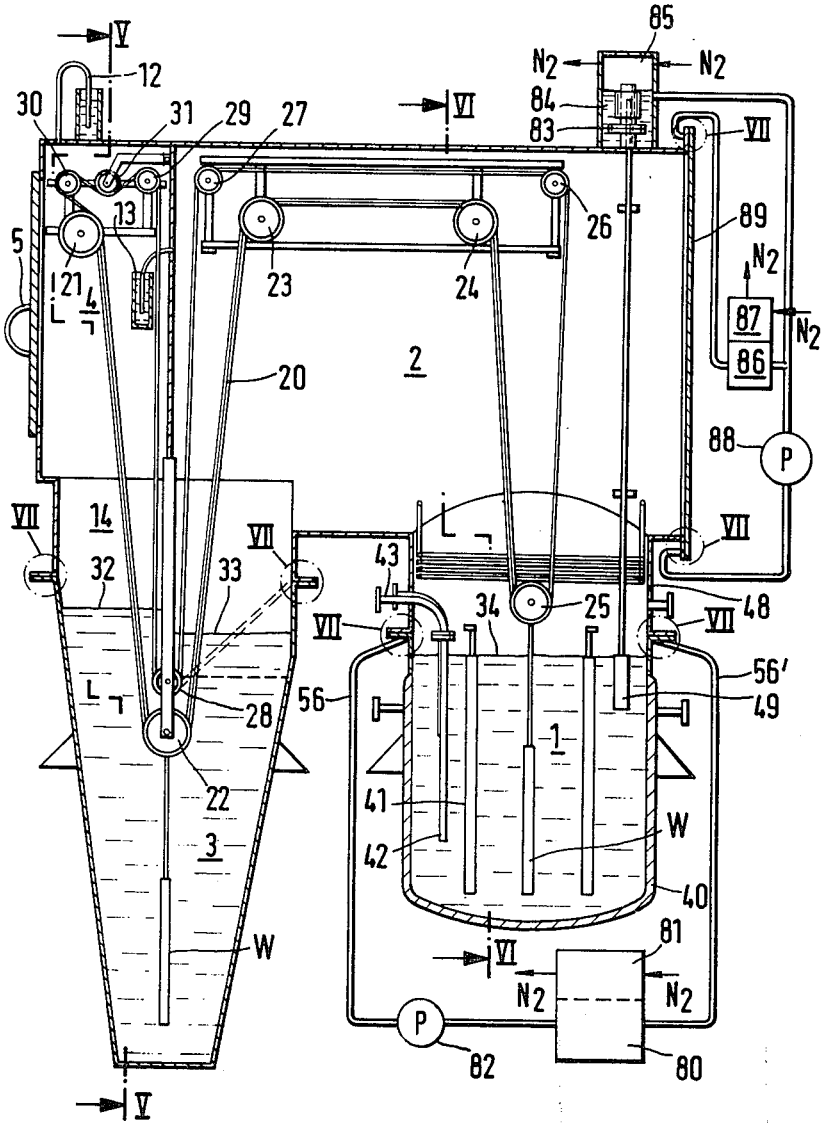
FIG. 3 is a more detailed view in vertical section of the apparatus shown in FIG. 2.
Figure 4:
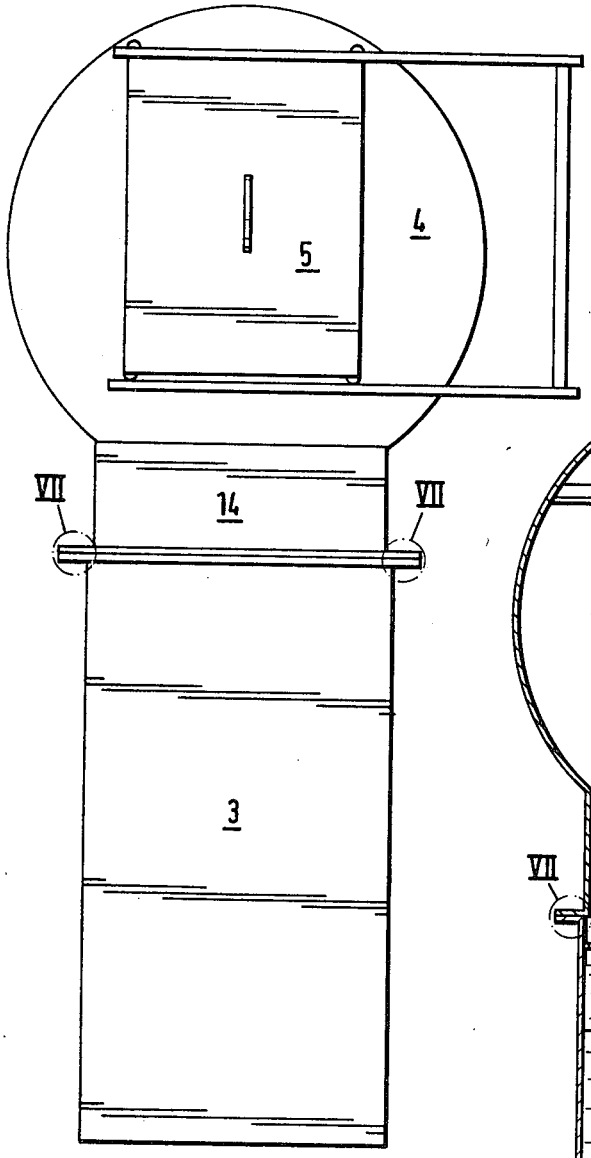
FIG. 4 is a side view taken from the left side of FIG. 3.
Figure 5:
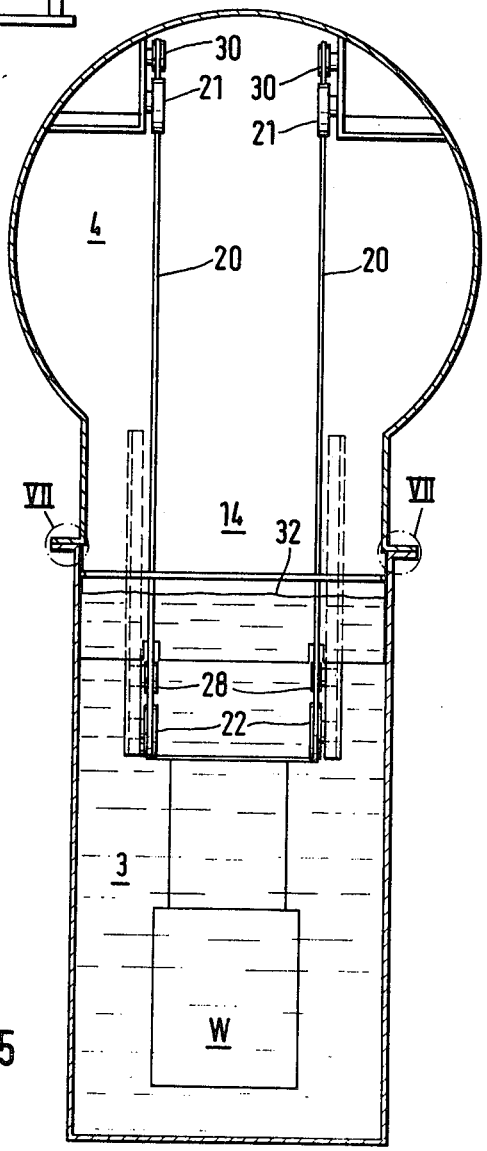
FIG. 5 is a schematic view in vertical section taken on the plane of the line 5—5 in FIG. 3.

The movement of goods in the aluminum plating cell according to the invention can be understood from FIGS. 3 to 6. The holders for individual workpieces W are brought in through the door 5, which closes with a substantially gas-tight seal and which, as best seen in FIG. 4, can be formed as a sliding door. Within the antechamber 4 the workpiece holders W are hung onto a conveyor that comprises two parallel-running endless chains or conveyor belts 20. In the direction of locking-in of the workpieces supports W, the conveyor belts or chains 20 run over a driving roller pair 21 in the antechamber 4, down to a roller pair 22 in the lock chamber 3, up to two horizontally spaced roller pairs 23 and 24 in the inert gas space 2, and down to a roller pair 25 in the head portion of the electroplating vessel 1. The remainder of the closed loop of the endless belts or chains 20 can be traced across roller pairs 26 and 27 by which they are carried over the roller pairs 23 and 24, over a roller pair 28 which is above the roller pair 22, and over two roller pairs 29 and 30 in the head portion of the antechamber 4. Between the last-mentioned two roller pairs 29 and 30 there is a spring urged tension roller pair 31.

The workpiece supports W that are hung in the antechamber 4 proceed in the following path during lock-in: antechamber 4, plenum chamber 14, beneath the liquid level 32 of the aprotic solvent in the lock chamber 3, above the liquid level 33 into the inert gas space 2, and then under the level of the electrolyte fluid 34 in the electroplating vessel 1. Locking out takes place in the opposite direction.

The walls that define the inert gas passageway 2 extend down into the liquid lock chamber 3 to a level beneath the surface of the liquid therein, while the plenum chamber 14 opens to the top of the liquid lock above the level of the liquid therein and externally to the walls of the inert gas passage. Therefore, since the inert gas in the inert gas space 2 has a higher pressure than that in the plenum chamber 14, the liquid in the lock chamber 3 has a lower level at its interface 33 with the gas in the inert gas space 2 than at its interface 32 with the plenum chamber gas.

The inert gas cushion that is maintained across the entry to the lock chamber 3 is as dry and oxygen-free as possible, and therefore the inert gas not only tends to prevent oxygen and moisture from being carried beyond the plenum chamber 14 but also tends to remove from the aprotic liquid in the lock chamber 3—which is preferably toluol any oxygen and moisture it may have picked up. As a result, the transport of $O_2$ in relation to the partial pressure is kept down to values too small to be measured with certainty, and the transport of water is reduced to about a factor of $10^2$ to $10^3$. If, for example, 200 ml of moist toluol (300 ppm $H_2O$), with a surface of 16 $cm^2$, is introduced with agitation into an argon atmosphere with 0.073 mbar $H_2O$, with a rate of flow of argon of 0.8 liters/min., the toluol dries in 2 hours to 25 ppm of $H_2O$, in 3 hours to 10 ppm and in 5 hours to 5 ppm. The partial pressures are thus lowered so that the exchange processes are slowed down remarkably, and the transported $H_2O$ and $O_2$ quantities are so slight that the electrolytes can be expected to have a useful life of at least about a year. This is to say that an economically satisfactory useful life of the electrolytes is obtained, and it becomes economically feasible to make and operate an electrolytic aluminum plating cell.

However, the electrolyte space in the cell must be sufficiently sealed off from the atmosphere. The partial pressure of $O_2$ in the atmosphere is about 200 mbar. Since the aluminum triethyl in the electrolyte space, in acting like a getter pump as described above, consumes oxygen even when it is present in quantities too small to be measured, the oxygen partial pressure relationship as between the outside atmosphere and the electrolyte space is essentially the same as would exist if the electrolyte space were a high vacuum installation.

The requirements for lowest possible leakage rates can be fulfilled with structure that is suitable for conventional chemical apparatus if seals such as are described hereinafter are employed for the electrolyte space and all chambers that lie in the path of pieces being locked into and locked out of that space. In general, each such seal comprises a sealing ring that forms a mechanical seal and also serves to contain a body of an aprotic solvent that provides a liquid barrier. The aprotic solvent for such seals can be, for example, paraffin oil that is oxygen-free and moisture-free; and, for its part, the aprotic solvent can be shielded with an inert gas that is oxygen-free and moisture-free. Normal-paraffin of n-C10 to n-C12 saturated hydrocarbons takes up about 10 ppm of $O_2$ at an $O_2$ partial pressure of 0.2 bar. This value can be reduced to less than 0.1 ppm by flushing with inert gas.

Apart from the seals to be described hereinafter, the electroplating vessel 1 is constructed in a conventional manner. It comprises a container 40 which constitutes the electroplating vessel proper and which is provided with a heating jacket. At its top the container 40 is covered over with a dome 48 which is fixedly connected with the inert gas space 2. Releasable seals, designated by VII in FIG. 3, makes it possible to disconnect the dome 48 from the container 40.

Electrodes 41 are removably suspended in the container 40, and conduits 42, submerged in the container 40 to provide for the circulation and filtration of the electrolytes, lead into the dome 48 with flanges 43. The electrodes 41 are of course provided with electrical connections, which are likewise led out through the dome 48 of the electroplating vessel. The cathode current lead is insulatedly led out of the antechamber 4 along with the chains 20 of the insulatedly suspended piece supports W.

As FIG. 6 shows, the workpieces W that have been introduced into the electroplating vessel are, in a known manner, caused to move while in that vessel. Serving for this purpose is an electric motor 44 which acts through an eccentric slide 45 and a connecting rod 46 to impart endwise back and forth motion to a horizontal supporting rod 47 for the workpiece supports. The supporting rod 47 is supported on opposite sides of the dome 48 in special seals which are designated by VIII in FIG. 6. These features of the supporting rod 47 will be more fully explained hereinafter.

There is also arranged in the electroplating vessel a level height sensor 49 which has leads that extend upwardly out through the dome 48 and the inert gas space 2.

As has already been mentioned, all releasable connections between the various container parts, and at the lead-out locations of ducts, cables and the like insofar as they lie in the path of transport of the workpieces to be electroplated, are formed in a special manner. An example of such a seal is shown in FIG. 7, which depicts the seals that are designated by VII in FIGS. 3 to 6.

As can be seen from FIG. 7, a flange 53 around the upper edge of the electroplating vessel container 40 has on its upper side three annular grooves 51, 52, 54 which extend around its circumference. The grooves 51 and 54 receive sealing rings of teflon, viton or a similar fluoropolymer material, while the circumferential groove 52 that lies between them forms a liquid space. The opposing flange 55 of the dome 48 has a flat finished underside which seats on the sealing rings in the grooves 51 and 54 and cooperates with them to close in the annular chamber that comprises the groove 52, so that said chamber can be filled with liquid. The two flanges 53 and 55 are pressed together by clamping jaws 57 and 58 that are tightened by means of a bolt 59.

Ducts 56 at opposite locations on the annular flange 55 open to the annular space 52 for introduction thereinto of an aprotic solvent, preferably paraffin oil. This introduction takes place in a closed circuit which is schematically depicted in FIG. 3. From a chamber 80 that is filled with paraffin oil, the paraffin oil is put into circulation through the ducts 56 and 56' by a pump 82. The chamber 80 opens upwardly to a further chamber space 81 which is charged with an inert gas cushion that shields the paraffin oil in the chamber 80. This inert gas, which is preferably $N_2$, is also caused to circulate.

The seal on the lead-out from the level measurement sensor 49, on the upper surface of the inert gas space 2, is formed in a generally similar manner. Here, as can be seen from FIG. 3, the connecting flanges 83 are surrounded by a paraffin oil bath 84 which is again shielded on its upper side by an inert gas cushion 85. In this case, the inert gas can be the same as in the chamber 81, and can thus be nitrogen, which is conducted through the same circuit as the nitrogen in the chamber 81 and such nitrogen as is provided for further seals for inert gas shielding. However, a separate circuit can be provided if, as FIG. 3 shows, there is provided a further chamber 86 filled with aprotic solvent, preferably paraffin oil, which is shielded with an inert gas cushion 87. In the illustrated example, the aprotic solvent is circulated by means of a pump 88, whereby the aprotic solvent is also introduced into the seals VII—VII that are provided on an inspection and mounting cover 89 which closes the inert gas space 2. The seals VII of the cover 89 are essentially formed like the seal described in connection with FIG. 7.

Figure 8:
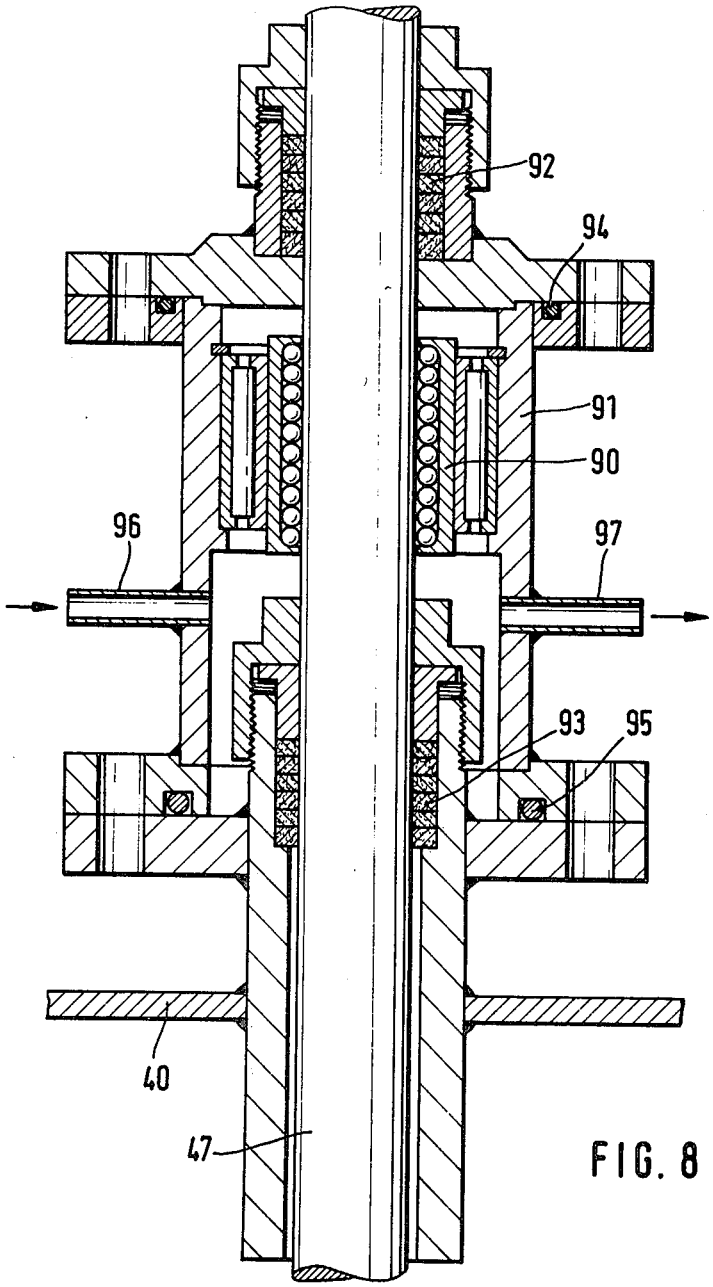
FIG. 8 is a view in vertical section showing the seals designated by VIII in FIG. 6.

The sealing for the workpiece agitating rod 47, generally designated by VIII in FIG. 6, is illustrated in more detail in FIG. 8. The agitating rod 47 is supported in a ball bushing 90 with superimposed needle bearings, surrounded by a tubular housing 91 which also forms the external support. The tubular housing 91 is coupled at both ends with flanged stuffing boxes 92 and 93, each of which is arranged in a known manner to enable a tubular packing to be axially compressed by means of a clamping nut and a pressure piece. On the flange connections at both ends of the tubular housing 91 there are provided sealing rings 94 and 95 that can be of teflon, viton or the like. According to the present invention, ducts 96, 97 are communicated with the interior of the tubular housing 91 to provide for circulation therethrough of an aprotic solvent. It will be observed that there is here, again, a series arrangement of a mechanical seal, a liquid seal and a further mechanical seal.

All electrical connection leads for supply of current to the electrodes and the leads of the resistance thermometer 49 and other control apparatus are fused into high vacuum lead-ins.

Seals generally similar to those described above are provided for the system in which the electrolyte is circulated through a filter. In that system, the necessary valves, the pump and the filter are preferably mounted in a vessel which is filled with paraffin oil and shielded with inert gas. For changing the filter, it is merely necessary to lower the paraffin level in this vessel. The inert gas, which preferably circulates in a closed circuit, can be led through a regenerator that reduces its water and oxygen content.

What is claimed as the invention is:

1. An aluminum electroplating cell of the type comprising an electroplating vessel adapted to contain liquid electrolyte up to an electrolyte level and lock means through which workpieces pass in moving into and out of said vessel and by which electrolyte in said vessel is substantially shielded from oxygen and moisture, said electroplating cell being characterized by:

A. said lock means comprising (1) a liquid lock chamber that is spaced from said vessel and adapted to hold aprotic solvent up to a predetermined level, (2) means defining an inverted-U-shaped passage which (a) at one of its ends opens to said liquid lock chamber at a level below said predetermined level and (b) at its other end opens to said vessel at a level about said electrolyte level, and (3) means for maintaining inert gas in said passage at an above-atmospheric pressure; and B. means defining an antechamber that has a sealable door and which can be charged with inert gas at an above atmospheric pressure, said antechamber opening downwardly to said liquid lock chamber to be communicated therewith at a level above said predetermined level.

2. The aluminum electroplating cell of claim 1 wherein said sealable door in the antechamber is near the top thereof and wherein a portion of the antechamber that is below said door comprises a plenum chamber.

3. The aluminum plating cell of claim 1, further characterized in that all seals between separable parts that lie along the path of transport of workpieces into and out of the electroplating vessel comprise (1) mechanical sealing means arranged to define a closed substantially annular chamber wherein a body of liquid can be confined that forms a barrier between the electrolyte and the atmosphere, and (2) means for maintaining aprotic liquid sealing medium in said substantially annular chamber.

4. The aluminum plating cell of claim 3, further characterized in that said mechanical sealing means is further adapted to define a space above said body of liquid into which an inert gas is charged to shield said liquid from oxygen and humidity.

5. The aluminum electroplating cell of claim 4, further characterized by means for circulating said inert gas in a regeneration circuit for reduction of its oxygen and water contents.

6. The aluminum electroplating cell of claim 3, further characterized by means for circulating said aprotic liquid sealing medium in contact with inert gas.

* * * * *